US008346542B2

(12) United States Patent
Iwata

(10) Patent No.: US 8,346,542 B2
(45) **Date of Patent: *Jan. 1, 2013**

(54) APPARATUS AND METHOD FOR WIDENING AUDIO SIGNAL BAND

(75) Inventor: Kazuya Iwata, Osaka (JP)

(73) Assignee: Panasonic Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/398,052

(22) Filed: Feb. 16, 2012

(65) Prior Publication Data

US 2012/0148072 A1 Jun. 14, 2012

Related U.S. Application Data

(62) Division of application No. 11/916,782, filed as application No. PCT/JP2006/309561 on May 12, 2006, now Pat. No. 8,145,478.

(30) Foreign Application Priority Data

Jun. 8, 2005 (JP) ..... 2005-167956

(51) Int. Cl.
*G10L 21/00* (2006.01)

(52) U.S. Cl. ..... 704/212; 704/224; 381/57

(58) Field of Classification Search ..... 704/212, 704/224; 381/57
See application file for complete search history.

(56) References Cited

U.S. PATENT DOCUMENTS

| | | | | |
|---|---|---|---|---|
| 5,133,014 | A | 7/1992 | Pritchard | |
| 5,841,875 | A | 11/1998 | Kuroki et al. | |
| 6,539,355 | B1 | 3/2003 | Omori et al. | |
| 6,804,649 | B2 * | 10/2004 | Miranda | 704/258 |
| 6,914,987 | B2 | 7/2005 | Blind et al. | |
| 7,715,573 | B1 | 5/2010 | Yonemoto et al. | |
| 8,145,478 | B2 * | 3/2012 | Iwata | 704/224 |
| 2005/0175185 | A1 | 8/2005 | Korner | |
| 2005/0187759 | A1 | 8/2005 | Malah et al. | |
| 2006/0227018 | A1 | 10/2006 | Ejima et al. | |
| 2006/0265210 | A1 | 11/2006 | Ramakrishnan et al. | |

FOREIGN PATENT DOCUMENTS

| | | |
|---|---|---|
| EP | 0 644 542 | 3/1995 |
| EP | 1 126 620 | 8/2001 |
| JP | 7-86840 | 3/1995 |
| JP | 7-93900 | 4/1995 |
| JP | 2000-134162 | 5/2000 |
| JP | 2002-55681 | 2/2002 |
| JP | 2002-528777 | 9/2002 |
| WO | 00/25305 | 5/2000 |

OTHER PUBLICATIONS

International Search Report issued Jun. 27, 2006 in International Application No. PCT/JP2006/309561.

(Continued)

*Primary Examiner* — Daniel D Abebe
(74) *Attorney, Agent, or Firm* — Wenderoth, Lind & Ponack, L.L.P.

(57) ABSTRACT

An audio signal band expanding apparatus (100*a*) includes a harmonic generator (3) that receives an input audio signal having a predetermined band and generates, based on the input audio signal, harmonic signals, and an adder (2) that adds the harmonic signals generated by the harmonic generator (3) to the input audio signal. The harmonic generator (3) simulates the input-output characteristics of a predetermined amplifier or that of a device to generate the harmonic signals from the input audio signal.

3 Claims, 14 Drawing Sheets

OTHER PUBLICATIONS

Patent Cooperation Treaty (PCT) International Preliminary Report on Patentability issued Dec. 11, 2007 in International Application No. PCT/JP2006/309561.

Supplementary European Search Report issued Feb. 4, 2010 in corresponding European Patent Application No. 06 73 2542.

* cited by examiner

APPARATUS AND METHOD FOR WIDENING AUDIO SIGNAL BAND

This application is a divisional of application Ser. No. 11/916,782, Dec. 6, 2007 now U.S. Pat. No. 8,145,478 which is the National Stage of International Application No. PCT/JP2006/309561, filed May 12, 2006.

TECHNICAL FIELD

The present invention relates to an apparatus and a method for expanding or widening an audio signal band, and particularly to the apparatus and method for widening the band of an input audio signal by applying digital processing to the input audio signal.

BACKGROUND ART

Patent document 1 discloses a conventional audio signal reproduction apparatus which generates high-order harmonic components based on a signal read from a recording medium and adds them to the read signal to realize a natural sound reproduction. FIG. 18 shows a configuration of the audio signal reproduction apparatus. In FIG. 18, the audio signal reproduction apparatus includes a low pass filter 171, a harmonic generating circuit 174 composed of an absolute-value circuit 173 and a multiplier 172, a high pass filter 175, an adder 176, and a D/A converter 177.

A digital audio signal inputted via an input terminal T1 is subjected to oversampling processing in the low pass filter 171. Then, the harmonic generating circuit 174 including the absolute value circuit 173 and the multiplier 172 generates harmonic signals based on an audio signal generated by the oversampling processing. The high pass filter 175 allows only high frequency components of the generated harmonic signal to pass through the filter 175. The adder 176 adds the output signal from the high pass filter 175 to the audio signal generated by the oversampling processing. The D/A converter 177 converts the added audio signal to an analogue signal, thus generating an audio signal of which band is expanded or widened and outputting the band expanded audio signal via an output terminal T2.

Patent document 1: JP-A-07-93900

DISCLOSURE OF INVENTION

Problem to be Solved by the Invention

As described above, the harmonic signals are generated based on the original audio signal, and the generated harmonic signals are added to the original audio signal, thereby expanding a width of high frequency band. However, the aforementioned conventional audio signal reproduction apparatus has a problem shown below.

(1) The harmonic signal generated by the harmonic generating circuit 174 includes only odd-order harmonic components.

(2) A level of each order of the generated harmonic component is fixed.

A natural musical sound has even-order harmonic components and odd-order harmonic components, and the level of each harmonic component is different for each musical sound. Therefore, an audio signal having characteristic of the aforementioned (1) and (2) has a different structure of harmonics from a natural musical signal and has a tone quality providing discomfort in a listening sense, depending on an input audio signal.

In order to solve the above-described problem, the present invention is provided, and the present invention has an object to provide an apparatus and method for expanding an audio signal band including the higher harmonic components that has a harmonic structure close to that of a natural musical sound, and being capable of reproducing a voice signal with no sense of incompatibility and deterioration in tone quality.

Means for Solving the Problems

In a first aspect of the invention, an apparatus for expanding a band of an audio signal is provided. The apparatus includes an input section for inputting an audio signal having a predetermined band, a harmonic generator for generating harmonic signals based on the input audio signal, and an adder for adding the harmonic signals generated by the harmonic generator to the input audio signal. The harmonic generator simulates input-output characteristics of a predetermined amplifier or a device included in the amplifier to generate the harmonic signals from the input audio signal.

In a second aspect of the invention, an audio reproduction apparatus is provided. The audio reproduction apparatus includes a signal reproducing unit for reproducing an audio signal from a recording medium storing audio information, the band expanding apparatus according to the invention, for expanding a band of an audio signal reproduced by the signal reproducing unit, and an amplifier for amplifying the audio signal outputted from the band expanding apparatus.

In a third aspect of the invention, a method of expanding a band of an audio signal is provided. The method includes inputting an audio signal having a predetermined band, simulating input-output characteristics of a predetermined amplifier or a device included in the amplifier to generate harmonic signals from the input audio signal, and adding the generated harmonic signals to the input audio signal.

Effect of the Invention

According to the present invention, the harmonic components are generated in a higher frequency range than that of the input digital audio signal, having the same spectral structure as that of the input audio signal. The harmonic components thus generated are added to the input audio signal, thereby expanding or widening the band. Particularly, according to the present invention, input-output characteristics of an audio amplifier and/or a circuit included in the audio amplifier is simulated to generate the harmonic components. Therefore, with simulation for the characteristic of a device regarded as having an excellent tone quality and an amplifier using such a device, it is possible to generate harmonic components equivalent to those generated by such a device and the amplifier using the device. The harmonic components thus generated include even-order and odd-order harmonics, thereby providing a harmonic structure close to that of a natural musical sound. Therefore, it is possible to realize a reproduction signal having natural tone quality without auditory discomfort and deterioration in tone quality, by providing such harmonic components into a final output audio signal.

REFERENCE SIGNS

Figure 1:
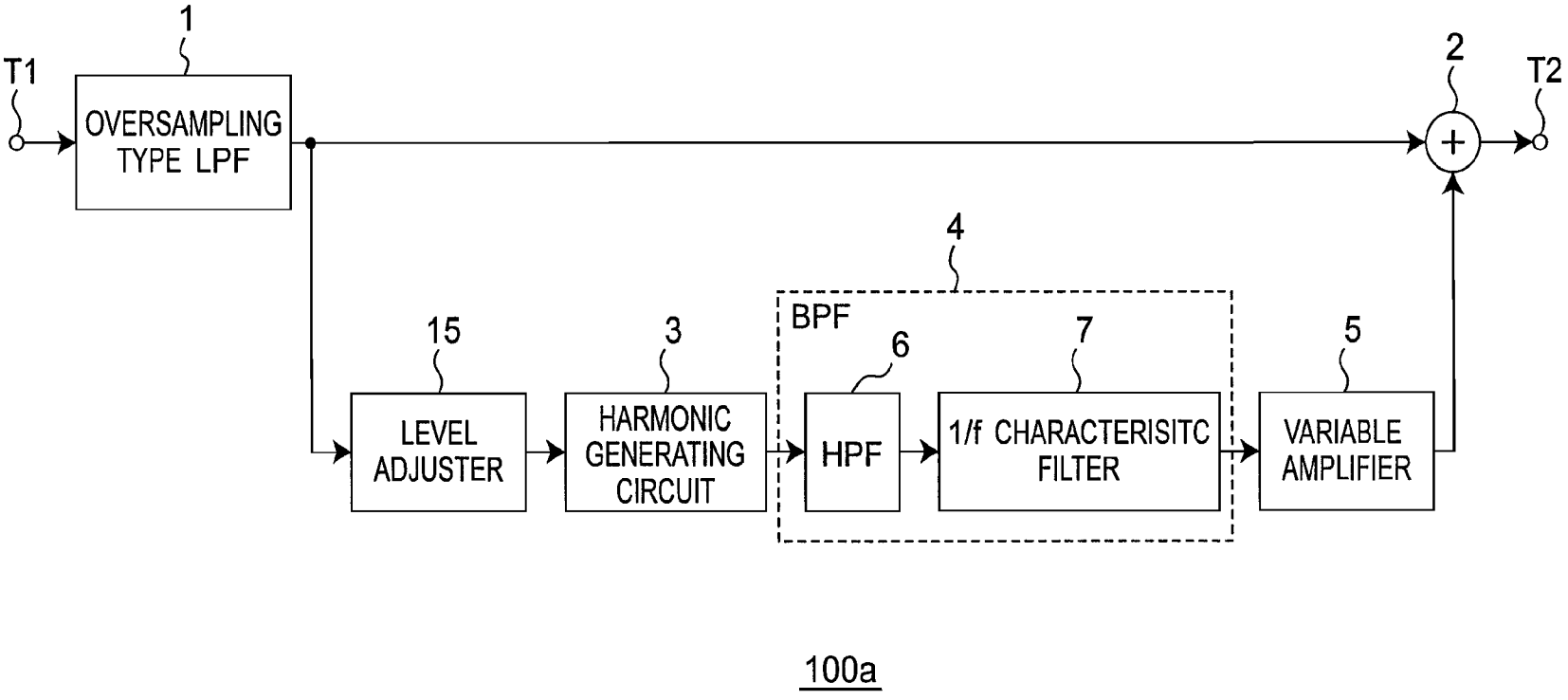
FIG. 1 is a block diagram showing a configuration of an audio signal band expanding apparatus according to Embodiment 1 of the present invention.

1 Oversampling type low pass filter
2, 10 Adder
3 Harmonic generating circuit
4 Digital band-pass filter
5, 9 Variable amplifier
6 Digital high pass filter
7 1/f characteristic filter
8 Noise signal generating circuit
11 Level detector
12 Quantization noise generating circuit
80 First-order delta-sigma modulation type quantizer
81 Subtractor
82 Quantizer
83 Subtractor
84 Delay circuit
100*a* to 100*c* Audio signal band expanding apparatus
120, 125 Audio reproduction apparatuses
T1 Input terminal
T2 Output terminal

BEST MODE FOR CARRYING OUT THE INVENTION

Hereinafter, preferred embodiments of the present invention will be explained with reference to the appended drawings. It is noted that in the appended drawings, the same reference signs and numerals are assigned to the same constituent elements.

Embodiment 1

FIG. 1 is a block diagram showing a configuration of an audio signal band expanding apparatus according to Embodiment 1 of the present invention. An audio signal band expanding apparatus 100*a* according to this embodiment is a digital signal processing circuit intervening between an input terminal T1 and an output terminal T2. The audio signal band expanding apparatus 100*a* includes an oversampling type low pass filter 1, a level adjuster 15, an adder 2, a harmonic generating circuit 3, a digital band-pass filter 4, and a variable amplifier 5. The digital band-pass filter 4 includes a digital high pass filter 6 and a 1/f characteristic filter 7 which are serially cascaded.

The audio signal band expanding apparatus 100*a* having the above-described configuration will be explained.

In FIG. 1, a digital audio signal is fed to the oversampling type low pass filter 1 via the input terminal T1. The digital audio signal is, for example, a signal reproduced from a compact disc (CD), which has a sampling frequency fs of 44.1 kHz and word-length of 16 bits.

Figure 2:
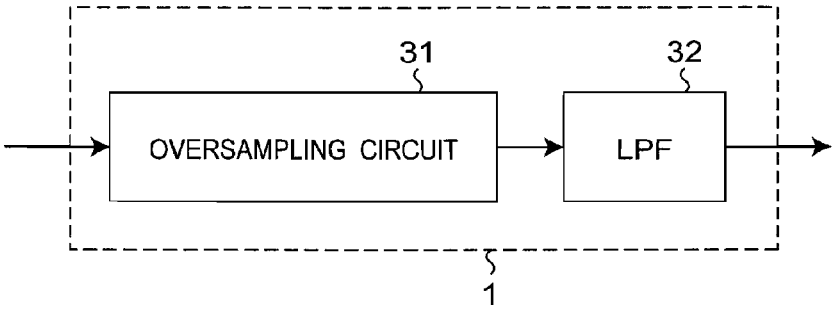
FIG. 2 is a block diagram showing a configuration of an oversampling type low pass filter.

As shown in FIG. 2, the oversampling type low pass filter 1 includes an oversampling circuit 31 and a digital low pass filter 32. The oversampling type low pass filter 1 is a digital filter circuit which multiplies a sampling frequency fs of the digital audio signal inputted via the input terminal T1 by p, and attenuates a signal of an unnecessary frequency band ranging from fs/2 to p*fs/2 by 60 dB or more. Note that "p" is a positive integer of 2 or more and is usually number of power of two. The oversampling circuit 31 performs the oversampling processing by interpolating an input digital audio signal.

Figure 3:
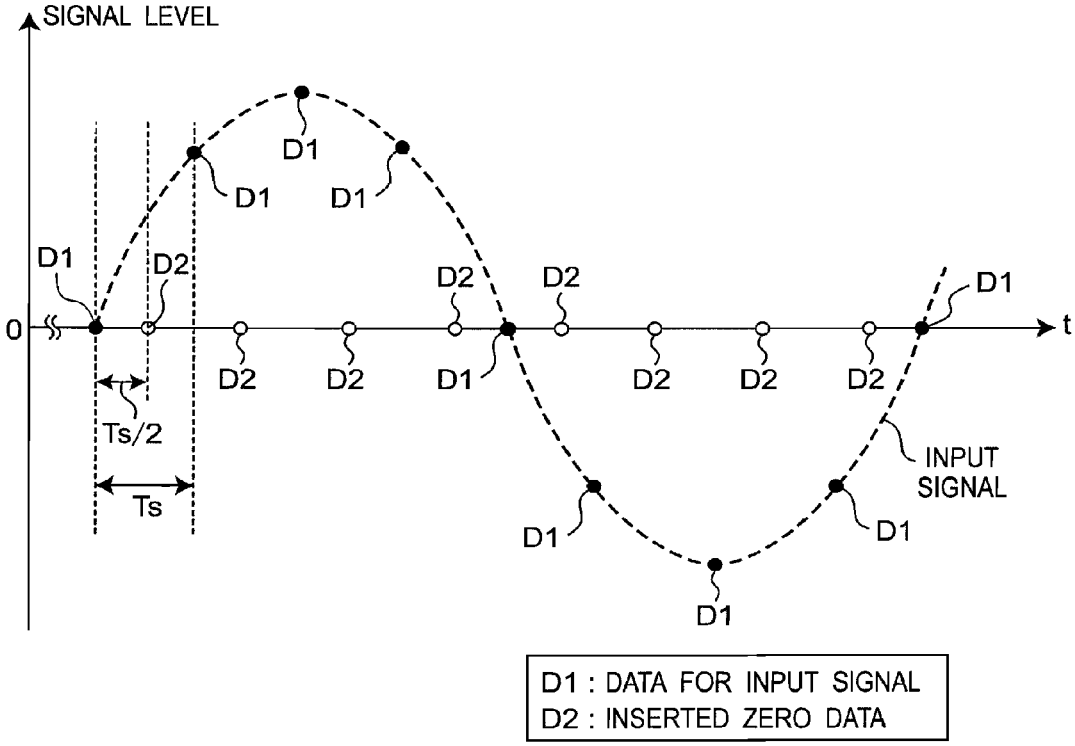
FIG. 3 is a view explaining an operation of an oversampling circuit.

For example, as shown in FIG. 3, when p is two, the oversampling circuit 31 performs the oversampling with respect to data D1 of the input digital audio signal having the sampling frequency of fs by interpolating with insertion of zero data D2 between adjacent data D1 on a time axis at a sampling cycle Ts. Thus, the oversampling circuit 31 converts the digital audio signal having the sampling frequency of fs (sampling cycle Ts) into the digital audio signal having the sampling frequency of 2fs (sampling cycle Ts/2), and thereafter outputs it to the digital low pass filter 32.

The digital low pass filter 32 has (a) a passing band of frequency of 0 to 0.45fs, (b) a rejection band of frequency of 0.45fs to fs, and (c) an attenuation quantity of 60 dB or more with a frequency of fs or more. The filter 32 allows predetermined low frequency components of the input digital audio signal to pass through itself. The digital low pass filter 32 limits the band so as to remove a return noise generated by the aforementioned oversampling processing. The filter 32 allows only a substantially effective band (frequency of 0 to 0.45fs) of the input digital audio signal to pass through itself, and outputs the signal of the passing band to the adder 2 and the harmonic generating circuit 3.

Figures 4A, 4B, 4C, 4D, 4E:
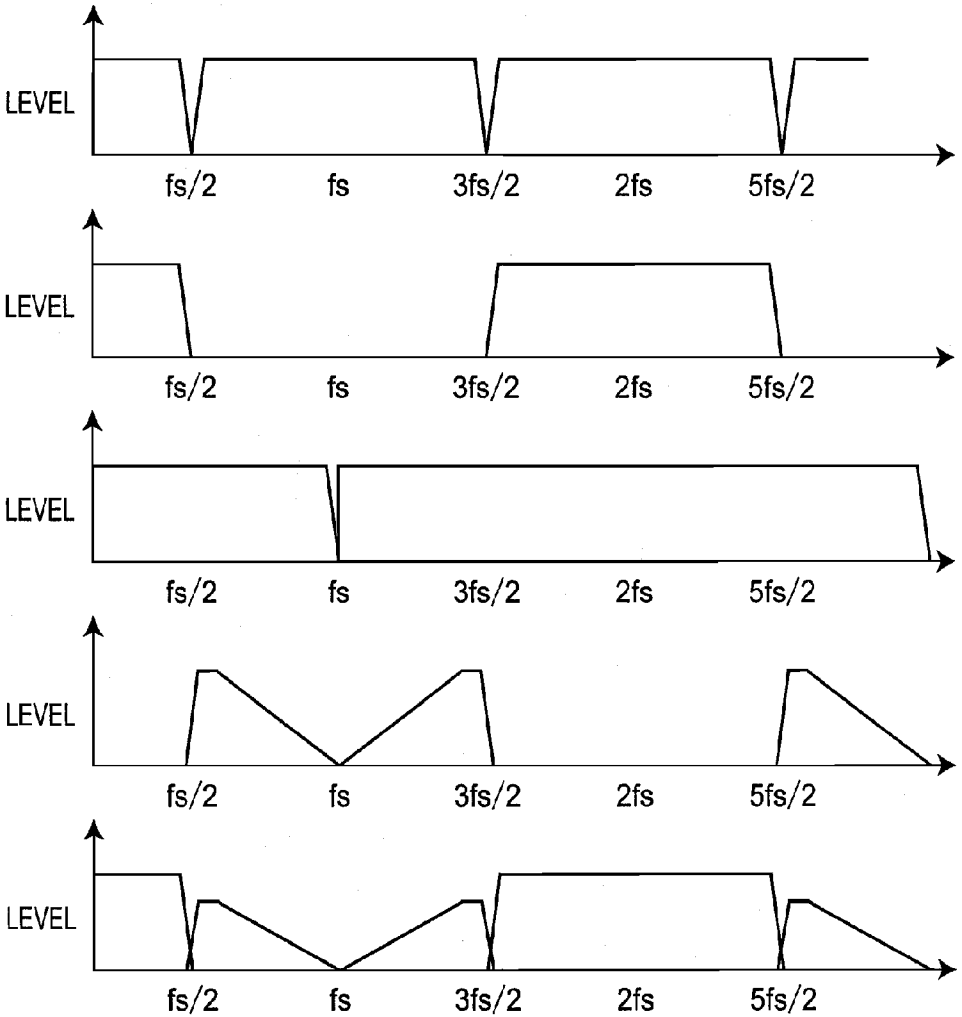
FIGS. 4A to 4E are views of spectra of output signals of processing sections of the audio signal band expanding apparatus.

FIG. 4A shows a spectrum of the audio signal inputted to the input terminal T1 and FIG. 4B shows a spectrum of the output signal from the oversampling type low pass filter 1, respectively.

The harmonic generating circuit 3 is a nonlinear processing circuit having nonlinear input-output characteristics. The harmonic generating circuit 3 applies nonlinear processing to the input digital audio signal, thereby distorting the digital audio signal to generate the harmonic signal and outputting the generated harmonic signal to the digital band-pass filter 4. A concrete realizing method is as follows. That is, the method includes simulating the amplifier with small signal parameters of devices included in the amplifier, that is, calculating the output signal of an audio amplifier by a DSP (Digital Signal Processor), by software processing by a processor, or by hardware processing in a digital circuit, to generate the harmonic signal of the input signal.

Figure 5:
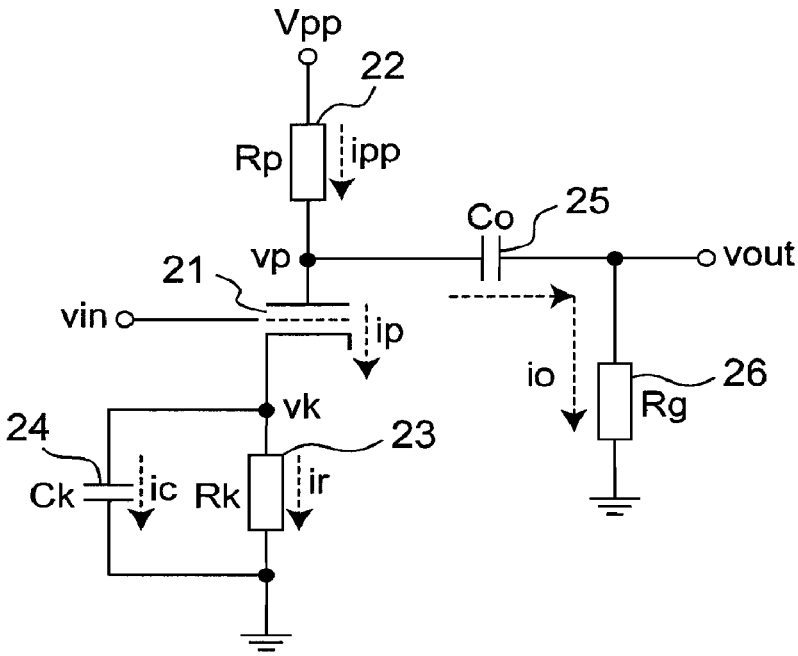
FIG. 5 is a view explaining a circuit configuration of an analogue vacuum tube amplifier to be simulated by a harmonic generating circuit.

The harmonic generating circuit 3 simulates the input-output characteristics of a vacuum tube amplifier as shown in FIG. 5, for example. That is, the harmonics generated by the harmonic generating circuit 3 have characteristic similar to the harmonics included in an output of the vacuum tube amplifier shown in FIG. 5. The vacuum tube amplifier shown in FIG. 5 is a self-bias type cathode grounded inverting amplifier using a triode valve. The vacuum tube amplifier has a triode valve 21 as an amplifying element, a load resistor 22, a cathode resistor 23, a cathode bypass capacitor 24, a coupling capacitor 25, and a resistor 26 for deciding a low frequency time constant.

A current and voltage of each device is expressed as follows, with a voltage signal vin applied to the input of the vacuum tube amplifier shown in FIG. 5, (Reference document: SPICE Models for Vacuum-Tube Amplifiers/W. MARSHALL LEACH, JR., Journal of The Audio Engineering Society, Vo. 43, No. 3 1995 March, pp. 117-126). Note that an amplification factor as a small signal equivalent parameter of the triode 21 is represented by μ, and a constant is represented by K.

$$vout=-Rg\cdot io$$

$$io=ipp-ip$$

$$ip=K(\mu\cdot vgk+vpk)^{3/2}$$

$$vgk=vin-vk$$

$$vpk=vp-vk$$

$$vk=1/Ck\cdot\int icdt$$

$$ip=ir+ic$$

$$vk=Rk\cdot ir$$

$$vp=Vpp-Rp\cdot ipp$$

$$vp=1/Co\cdot\int iodt+Rg\cdot io$$

When 12AX7 by RCA Corporation is used in the triode 21, a constant example is shown below.

[Example Constants]

Rp=220 kΩ
Rk=3.5 kΩ
Rg=200 kΩ
Ck=2.1
Co=0.006
Vpp=360 V

[12AX7]

$K=1.73\times10^{-6}$
μ=83.5

Conceptually, the output of the oversampling type low pass filter 1 is inputted as vin in FIG. 5, and a generated harmonics are outputted as vout.

Actually, by using the aforementioned formula and constant, vout is calculated by software or hardware, to thereby generate the harmonics.

The level of the signal inputted in the harmonic generating circuit 3 can be changed by the level adjuster 15. Changing of level of a signal inputted to the harmonic generating circuit 3 causes a spectral structure of the harmonic signal outputted from the harmonic generating circuit 3 to be changed. Specifically, the larger the signal level inputted to the harmonic generating circuit 3 is, the larger the higher harmonic level becomes, while the smaller the inputted signal level is, the smaller the higher harmonic level becomes. This is because the harmonic generating circuit 3 simulates the audio amplifier having the nonlinear characteristic and the spectral structure of harmonics for the output signal is changed based on the level of the input signal. For example, the audio amplifier has the nonlinear characteristic in that the audio amplifier can not output a signal having the amplitude of not less than a power supply voltage. In addition, the devices included in the audio amplifier also have nonlinear characteristic which particularly become prominent in the vicinity of the power supply voltage. Therefore, when an amplitude level of the input signal is made larger, the nonlinearity strongly appears in the output signal. Such a phenomenon causes the harmonic level to change. Change of the signal level inputted to the harmonic generating circuit 3 causes the spectral structure of the harmonics to change, thus making it possible to control the tone quality.

As shown in FIG. 1, the band-pass filter 4 includes the serially-cascaded high pass filter 6 and 1/f characteristic filter 7 as the low pass filter. For example, when the input digital audio signal is a not-compressed digital signal reproduced from a CD, or the like, the band-pass filter 4 has preferably the following specifications.

(1) Cutoff frequency fLC of a low frequency region=approximately fs/4.

(2) Cutoff characteristic of the low frequency region shows attenuation quantity of 80 dB or more at a frequency of fs/4. The attenuation quantity is laid in the vicinity of S/N ratio based on quantization numbers of the original sound. For example, when the quantization number of the original sound is 16 bits, a theoretical S/N ratio is 98 dB, and therefore the attenuation quantity is preferably in a range from 80 to 100 dB or more. Gradual cutoff characteristic of the low frequency region produces a soft tone quality, while steep cutoff characteristic of the low frequency region produces a sharp tone quality. In the latter case, effect of band expanding can be achieved without deteriorating trend of a tone quality of the original sound. Accordingly, the cutoff characteristic of the low frequency region of the digital low pass filter 7 may be made switchable from an external controller so as to be selectively changed between the aforementioned two characteristics according to an instruction signal by a user.

(3) Cutoff frequency of fHC of a high frequency region=approximately fs/2.

Figure 6:
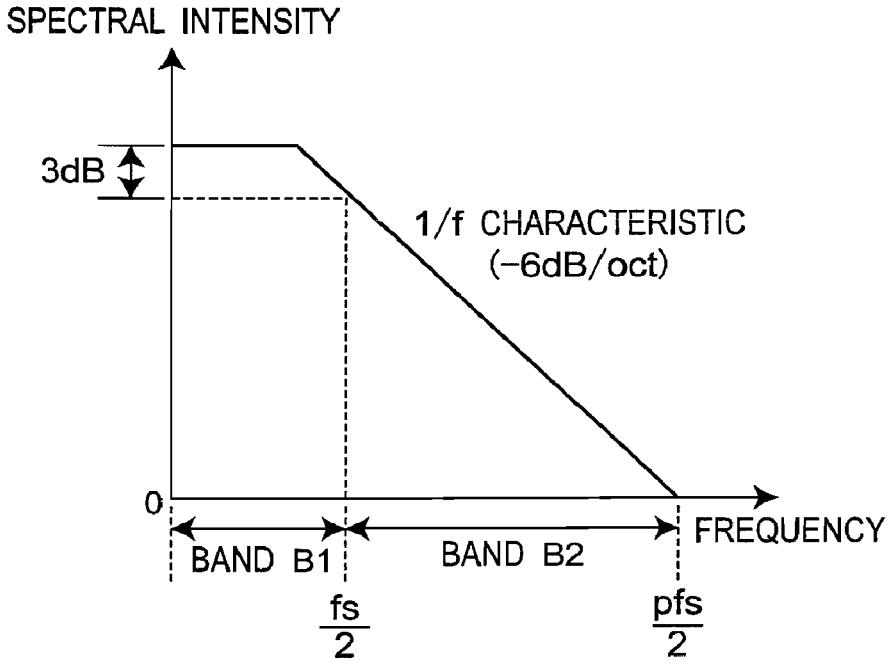
FIG. 6 is a spectral chart showing frequency characteristic of a 1/f characteristic filter.

(4) Cutoff characteristic of the high frequency region is −6 dB/oct (see FIG. 6).

The 1/f characteristic filter 8 is so-called low pass filter of 1/f characteristic, provided with attenuation characteristic having an inclination of −6 dB/oct in the frequency band B2 ranging from fs/2 to p*fs/2, which is higher than the frequency band B1 ranging from 0 to fs/2, as shown in FIG. 6. The constant "p" indicates an oversampling rate and is approximately an integer of 2 to 8, for example.

As described above, the band-pass filter 4 filters the digital signal inputted from the harmonic generating circuit 3. A digital signal which is filtered and provided for band-expanding is outputted to the adder 2 via the variable amplifier 5.

The adder 2 adds the digital signal for band-expanding is expanded from the variable amplifier 5 to the low-pass filtered digital audio signal from the oversampling type low pass filter 1. Then, the digital audio signal resulting from the addition including the digital signal for band-expanding and digital audio signal of the original sound is outputted via the output terminal T2.

The variable amplifier 5 is a level control circuit. The variable amplifier 5 changes a level (amplitude level) of the input signal with an amplification factor based on a control signal and outputs the signal with the level changed to the adder 2. Note that the amplification factor can be set to a value at which both positive and negative amplification processes are possible. That is, the variable amplifier 5 can amplify the input signal and control a normal/reverse control of attenuation and phase. The variable amplifier 5 is used for relatively adjusting a level of the digital audio signal from the oversampling type low pass filter 1 and a level of the digital signal for band-expanding from the band-pass filter 4. Preferably, in the adder 2, the adjustment is made so that levels of these two signals are identical at the frequency of fs/2, for example, that is, so that continuity of the spectrum is maintained. In addition, the adjustment may be changed according to a listener's taste.

FIG. 4C shows an output spectrum of the harmonic generating circuit 3. FIG. 4D shows an output spectrum of a band-pass filter 4. FIG. 4E shows schematically the spectrum of the harmonics outputted from the output terminal T2.

As described above, according to this embodiment, the band is expanded in such a way that the harmonic signals having the spectral structure similar to that of the musical sound are generated in a frequency band higher than an original frequency band of the input audio signal. Then, the frequency band of the harmonic signals is limited by the band-pass filter 4 and the level of the harmonic signal is controlled. Finally, the harmonic signals are added to the input audio signal, thereby expanding the band of the input audio signal. The higher harmonics thus generated includes the even-order harmonics which provide good tone quality and are considered to be comfortable in listening.

Particularly, according to this embodiment, the harmonic generating circuit 3 simulates the input-output characteristics of the audio amplifier or the devices composing the audio amplifier to generate the harmonics. The simulating generates harmonics equivalent to those generated by the amplifier or the devices composing the amplifier. For example, simulating the characteristic of the amplifier evaluated to have a good tone quality or the devices composing the amplifier allows the harmonics having better tone quality and being comfortable to the listener to be generated. Generally, there is an organoleptic evaluation in that the vacuum tube amplifier has a more preferable tone quality than that of the amplifier including semiconductor devices, or there is a difference in tone quality between these amplifiers. Therefore, the band can be widened maintaining tone quality characteristic of the vacuum tube amplifier by making a simulation so as to include tone quality characteristic (input-output characteristics) of the vacuum tube amplifier and generating the harmonics.

In addition, change of a setting of parameters for simulation allows the level of each order of the harmonic component to be easily changed. A difference in devices (such as vacuum tube) or a difference in circuit configuration (configuration of output stage is single or push-pull) produces a difference in tone quality. Also, the difference in tone quality can be reflected on the characteristic of the generated harmonics by suitably setting the parameters, thus achieving the band expanding using the characteristic of the devices or the circuit configuration.

According to the above-described embodiment, the harmonic generating circuit 3 simulates the vacuum tube amplifier using a triode to generate the harmonics. However, a target to be simulated may be an arbitrary circuit or device. The effect in tone quality which is similar to the effect due to the harmonics generated by the simulated circuit or device can be obtained.

In addition, in the above-described embodiment, the band-pass filter 4 limits the band of the output of the harmonic generating circuit 3, and thereafter the variable amplifier 5 changes the level. However, the level may be changed in first and thereafter the band may be limited. The similar advantage can be obtained.

In addition, according to the above-described embodiment, the harmonic generating circuit 3 models the characteristic (input-output characteristics) caused by the audio amplifier or device included in the audio amplifier to generate the harmonics. However, other audio equipment (such as a speaker or a cartridge) may be modeled for simulation. In this case also, the band expanding effect can be similarly obtained. For example, the harmonic generating circuit 3 can also be realized by applying impulse response of certain audio equipment (such as a speaker or a cartridge) to the digital filter.

Figure 7:
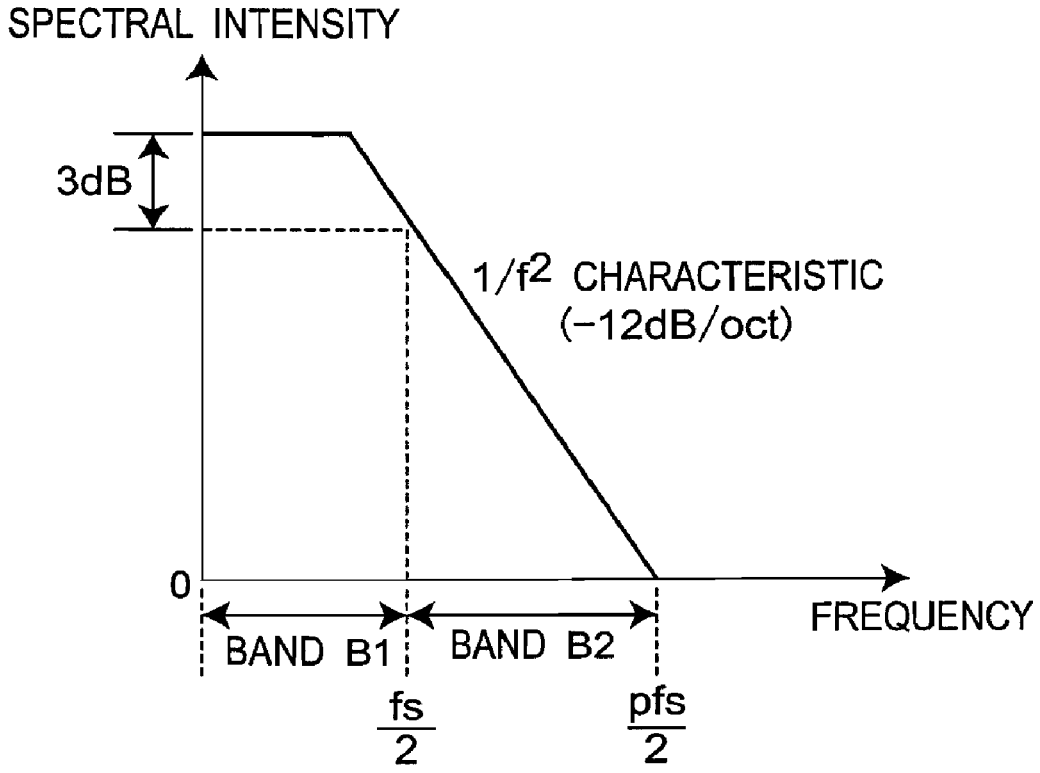
FIG. 7 is a spectral chart showing the frequency characteristic of a $1/f^2$ characteristic filter that can replace the 1/f characteristic filter.

Further, although the 1/f characteristic filter is used in the above-described embodiment, instead of it a $1/f^2$ characteristic filter having attenuation characteristic shown in FIG. 7 may also be used. As shown in FIG. 7, the $1/f^2$ characteristic filter is the low pass filter provided with the attenuation characteristic having −12 dB/oct slope in the frequency band B2 ranging from fs/2 to p*fs/2, which is higher than the frequency band B1 ranging from 0 to fs/2.

In the above-described embodiment, explanation is made to a preferable specification of the band-pass filter 4 for an input digital audio signal which is not compressed and originates from the CD or the like. When the input digital audio signal is a digital signal (hereinafter referred to as "MD signal") from a MD (Mini Disc), or a digital audio signal (hereinafter referred to as "AAC signal") compressed and encoded by AAC (Advanced Audio Coding) used in an audio signal of MPEG-4, it is preferable to set the cutoff frequency fs/2 of the low and high frequency regions of the band-pass filter 4 at an upper limit frequency of a reproduction band of these compressed audio signals. Sampling frequencies fs of an MD signal and an AAC signal are, for example, set at 44.1 kHz or 48 kHz, and the sampling frequency fs for a half rate signal of the AAC signal is set at 22.05 kHz or 24 kHz. In the former case, the upper limit frequency of the reproduction band is approximately set at 10 kHz or 18 kHz. In the latter case, the upper limit frequency of the reproduction band is set at approximately 5 kHz or 9 kHz.

Embodiment 2

Figure 8:
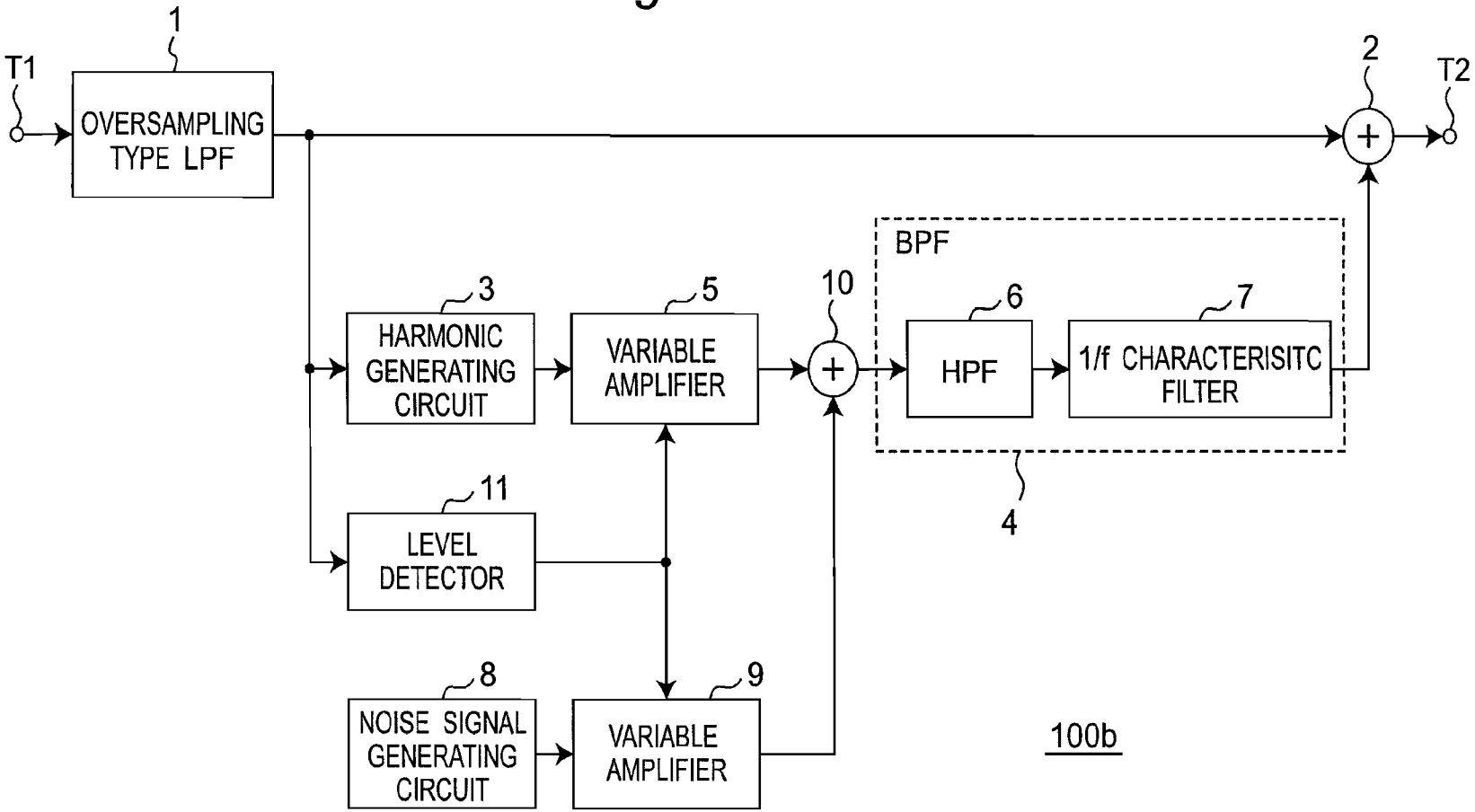
FIG. 8 is a block diagram showing the configuration of the audio signal band expanding apparatus according to Embodiment 2 of the present invention.

FIG. 8 is a block diagram showing a configuration of an audio signal band expanding apparatus according to Embodiment 2 of the present invention. An audio signal band expanding apparatus 100*b* according this embodiment includes an oversampling type low pass filter 1, an adder 2, a harmonic generating circuit 3, a digital band-pass filter 4, and a variable amplifier 5. Further, the audio signal band expanding apparatus 100*b* includes a noise signal generating circuit 8 for generating a noise signal not correlated to the original sound, a variable amplifier 9 capable of changing the output of the noise signal generating circuit 8, an adder 10 for adding outputs of the variable amplifier 5 and the variable amplifier 9, and a level detector 11. Functions and operations of the oversampling type low pass filter 1, the adder 2, the harmonic generating circuit 3, the digital band-pass filter 4, and the variable amplifier 5 are the same as explained in Embodiment 1.

The harmonic generating circuit 3 generates the harmonics based on the output signal of the oversampling type low pass filter 1. The variable amplifier 5 changes the level of the harmonics to be added by the adder 2.

The noise signal generating circuit 8 generates a random noise. The random noise has the frequency band from 0 to p*fs/2, is not correlated to the input audio signal, and has a random amplitude level with respect to the time axis. Here, "fs" is a sampling frequency of the audio signal inputted from the input terminal T1, and "p" is the oversampling rate of the oversampling type low pass filter 1.

Figure 9:
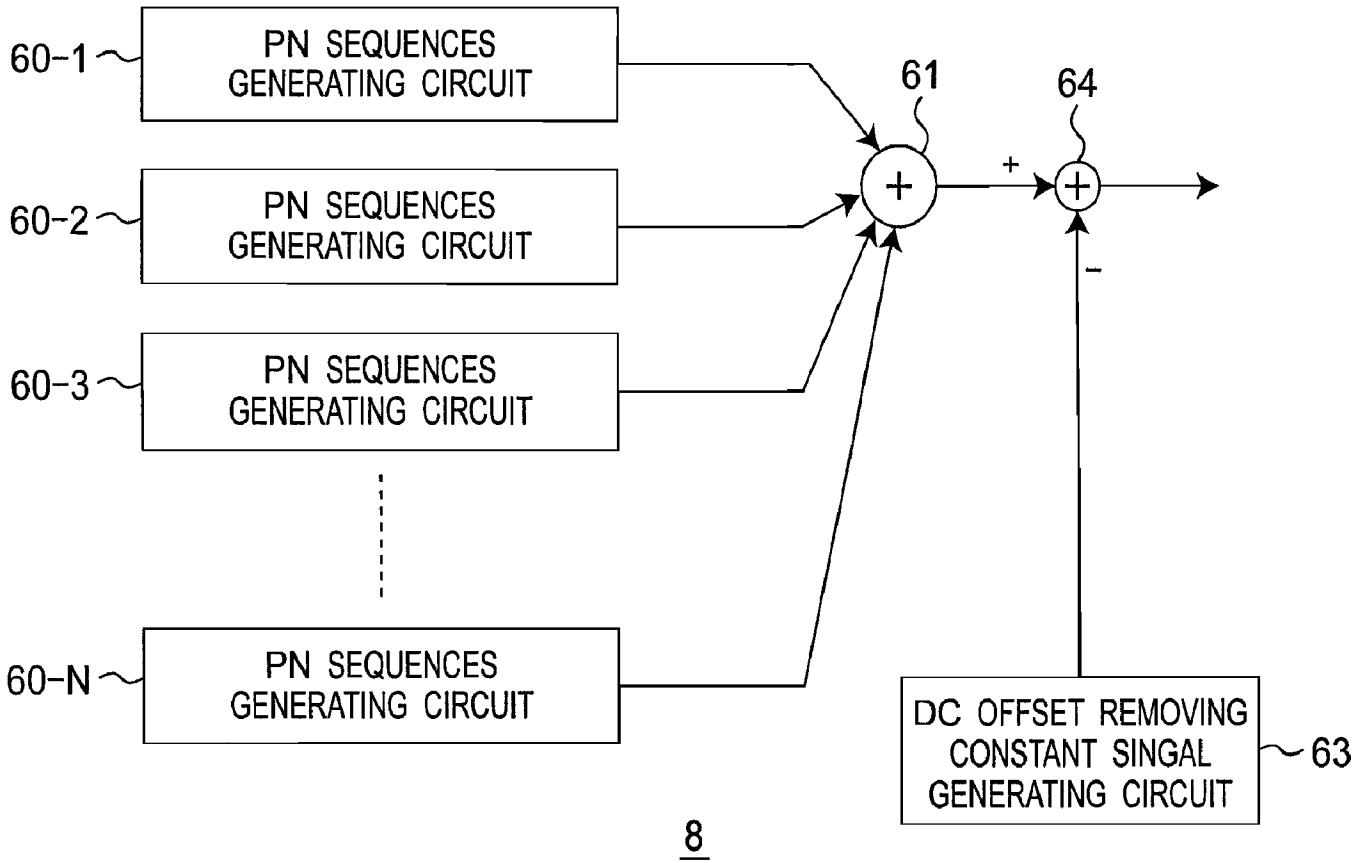
FIG. 9 is a block diagram showing the configuration of a noise signal generating circuit according to Embodiment 2.

FIG. 9 shows an example of specific configuration of the noise signal generating circuit 8. The noise signal generating circuit 8 includes a plurality (N) of pseudo noise sequences noise signal generating circuits (hereinafter referred to as "PN sequences generating circuits") 60-*n* (n=1, 2, . . . , N); an adder 61, a DC offset removing constant signal generating circuit 63, and a subtractor 64.

Each PN sequences generating circuit 60-*n* has an independent initial value. Each PN sequences generating circuit 60-*n* generates, for example, a pseudo noise signal which is an M-series noise signal having a uniform random amplitude level, and outputs it to the adder 61. Subsequently, the adder 61 sums up the plurality of (N) pseudo noise signals outputted from the plurality of PN sequences generating circuits 60-1 to 60-N, and outputs the sum of the pseudo noise signals to the subtractor 64. Meanwhile, the DC offset removing constant signal generator 63 generates a DC offset removing constant signal which is a sum of time average values of the pseudo noise signals from the plurality of (N) PN sequences generating circuits 60-1 to 60-N, and outputs the generated signal to the subtractor 64. Then, the subtractor 64 subtracts the DC offset removing constant signal from the sum of the pseudo noise signals, thereby generating and outputting a dither signal having no DC offset.

Figure 10:
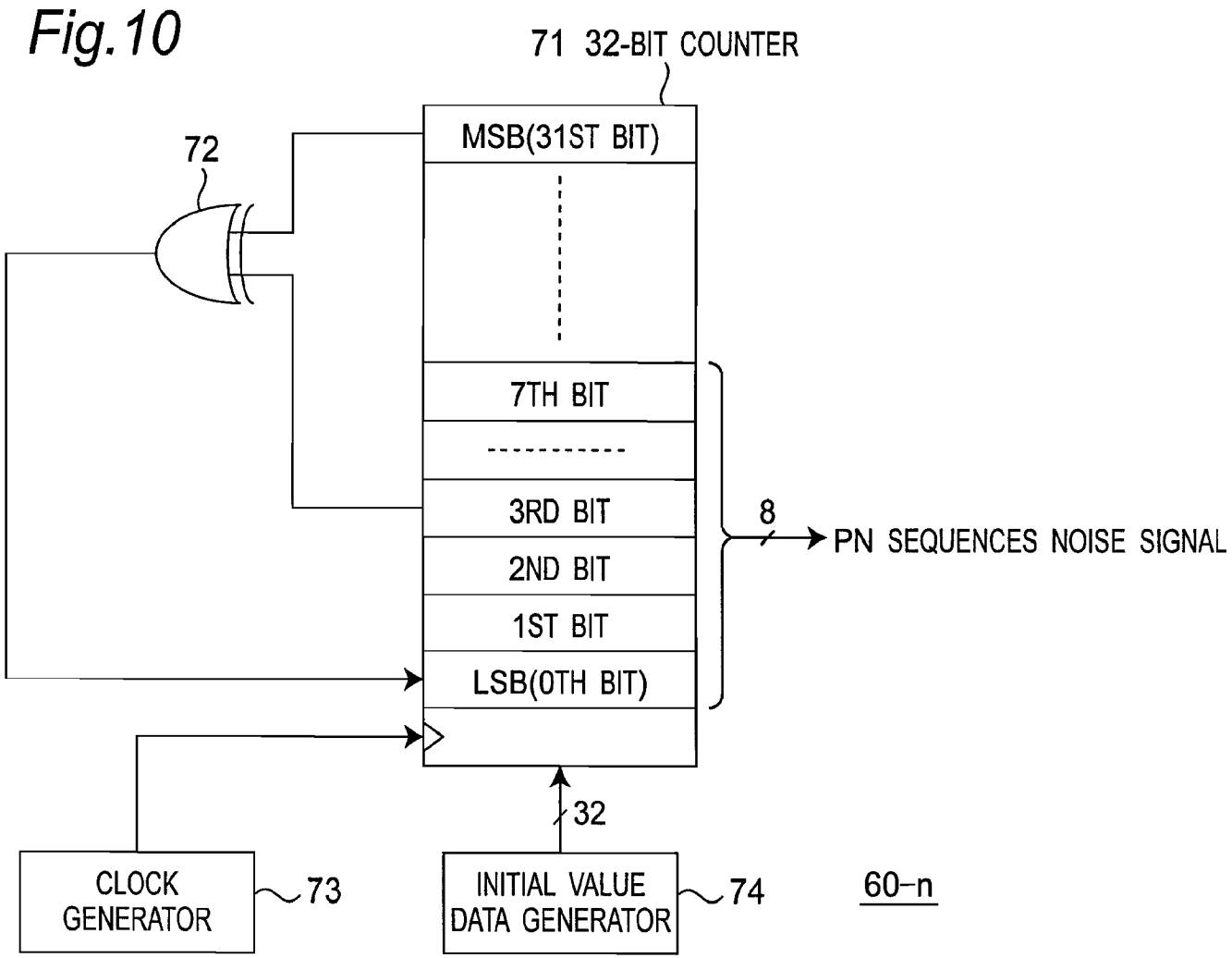
FIG. 10 is a block diagram showing the configuration of a PN sequences generating circuit in a noise signal generating circuit.

FIG. 10 shows the configuration of the PN sequences generating circuits 60-*n* (n=1, 2, . . . , N). The PN sequences generating circuits 60-*n* (n=1, 2, . . . , N) include a 32-bit counter 71, an exclusive OR gate 72, a clock generator 73, and an initial value data generator 74. Initial values of 32 bits different for each PN sequences generating circuit 60-*n* are set in the 32-bit counter 71 from the initial value data generator 74. Thereafter, the 32-bit counter 71 increments the value by one based on a clock signal generated by the clock generator 73. One bit data of the most significant bit (MSB; 31-th bit) and one bit of a third bit in the 32 bit data (including the data of 0 to 31-th bit) of the 32-bit counter 71 are inputted in the input terminal of the exclusive OR gate 72. The exclusive OR gate 72 sets one bit data as the result of exclusive OR to a least significant bit (LSB) of the 32-bit counter 71. Then, the lower 8 bits of data of the 32-bit counter 71 is outputted as the PN sequences noise signal. According to the PN sequences generating circuits 60-*n* thus configured, each PN sequences noise signal outputted from the respective PN sequences generating circuit 60-*n* becomes a PN sequences noise signal of 8 bits which is mutually independent.

In an example of FIG. 10, the aforementioned configuration is provided to generate the mutually independent PN sequences noise signal of 8 bits in each PN sequences generating circuit 60-*n*. However, the present invention is not limited thereto and the following configuration may also be provided:

(1) bit positions of the 8-bit PN sequences noise signal taken out from the 32-bit counter 71 may be mutually differentiated. That is, the PN sequences generating circuit 60-1 takes out the 8-bit PN sequences noise signal from the least significant 8 bits, and the PN sequences generating circuit 60-2 takes out the PN sequences noise signal from 8 bits just above the least significant 8 bits. In other PN sequences generating circuit 60-*n* also, the PN sequences noise signal is similarly taken out;

(2) the bit position of the 32-bit counter 71 for taking out one bit data inputted to the exclusive OR gate 72 may be mutually differentiated in each PN sequences generating circuits 60-*n*; or (3) at least two of the example shown in FIG. 10, the aforementioned example (1), and the aforementioned example (2) may be combined.

Figure 11:
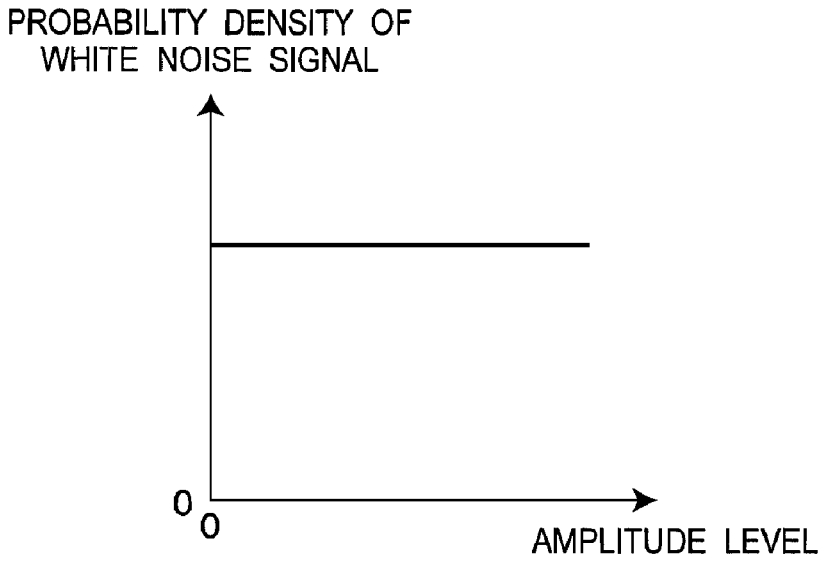
FIG. 11 is a graph showing a probability density function with respect to an amplitude level of a white noise signal that can be generated by the PN sequences generating circuit.
Figure 12:
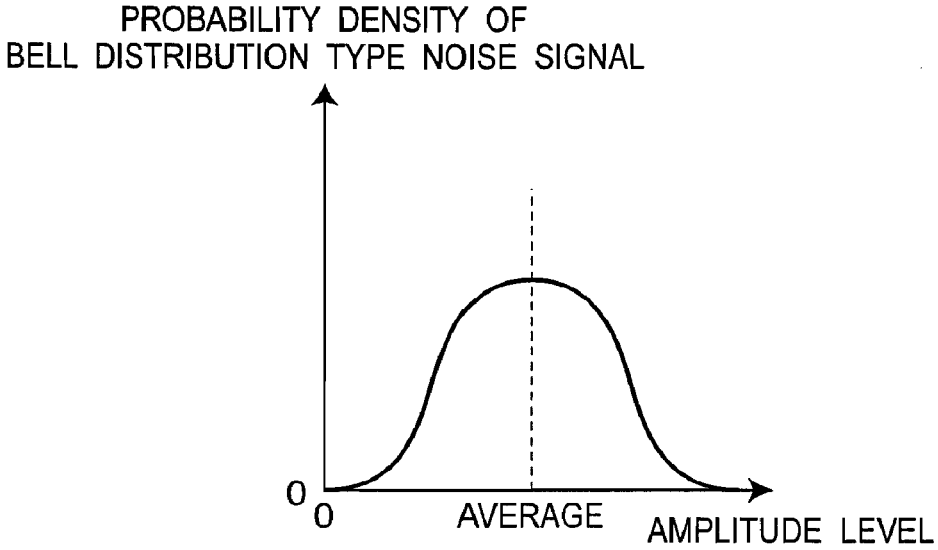
FIG. 12 is a graph showing a probability density function with respect to an amplitude level of Bell distribution type noise signal that can be generated by the PN sequences generating circuit.
Figure 13:
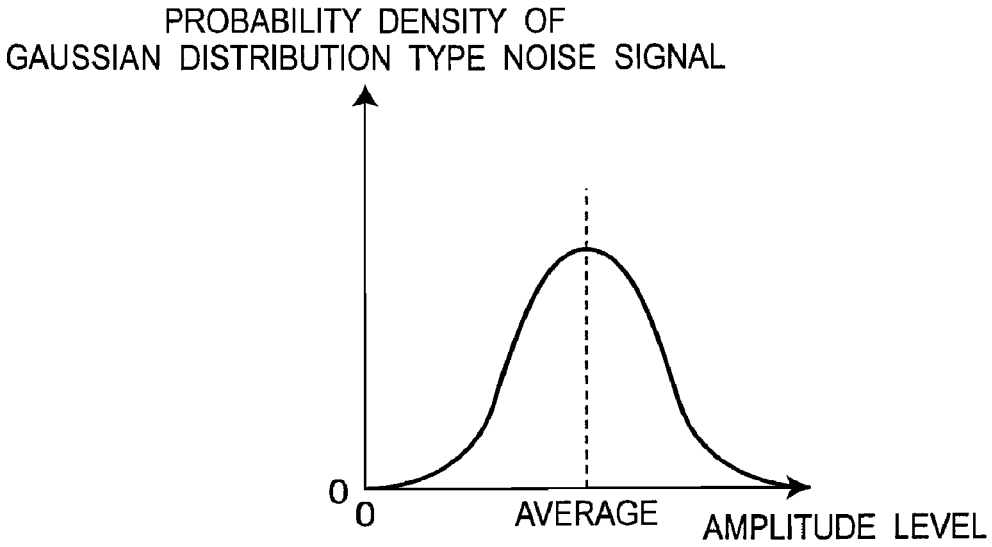
FIG. 13 is a graph showing a probability density function with respect to the amplitude level of Gaussian distribution type noise signal that can be generated by the PN sequences generating circuit.

Then, by adding mutually independent plurality of PN sequences noise signals, the PN sequences noise signal having a probability density with respect to the amplification level can be generated, as shown in FIG. 11, FIG. 12, and FIG. 13. For example, in case of n=1, as shown in FIG. 11, a white noise signal having the probability density of a uniform distribution with respect to the amplitude level can be generated. Also, if a central-limit theorem is used, the Gaussian distribution shows a variance of 1/12. Therefore in case of n=12, as shown in FIG. 12, a Gaussian distribution type noise signal having the probability density of Gaussian distribution with respect to the amplitude level can be generated by adding PN sequences noise signals from the PN sequences generating circuits 60-*n* that generates twelve uniform random numbers. Further, in case of n=3, as shown in FIG. 11, a bell distribution type noise signal can be generated. The bell distribution type noise signal has a variance which is close to or slightly larger than a variance of the Gaussian distribution, and has the probability density of a bell type distribution or a hanging bell type distribution with respect to the amplitude level. As described above, with a circuit configuration shown in FIG. 9 and FIG. 10, for example, a dither signal close to natural sound or musical sound can be generated with a small-scale circuit by generating the noise signal shown in FIG. 12 or FIG. 13.

Figure 14:
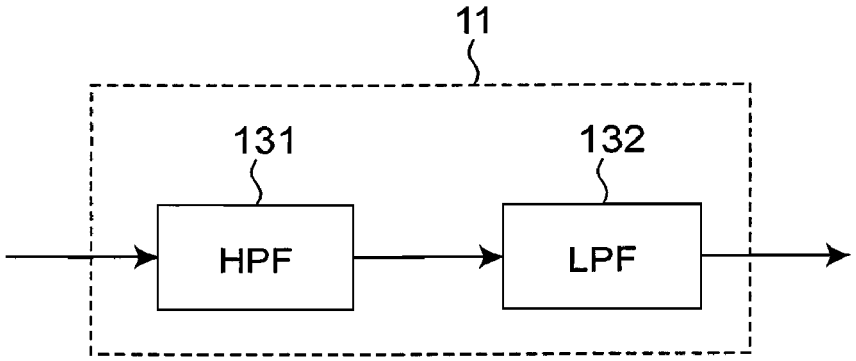
FIG. 14 is a block diagram showing the configuration of a level detector.

The level detector 11 detects a level fluctuation of the original audio signal which is subjected to the oversampling processing. Gains of the variable amplifier 5 and the variable amplifier 9 are changed according to a detection result of the level detector 11. As shown in FIG. 14, the level detector 11 is composed of a high pass filter 131 and a low pass filter 132 that are subordinately connected thereto. For example, when the audio signal inputted from the input terminal T1 is a signal from the CD, the passing band of the high pass filter 131 is set at 16 kHz or more, and the passing band of the low pass filter 132 is set at several hundreds Hz or less, thus making it possible to detect the level of the signal that passes the high pass filter 131. Based on the detected signal, the gains of the variable amplifier 5 and the variable amplifier 9 are changed. Thus, it becomes easy to match a level of the signal for band-expanding with a level of the original input signal of which band is to be expanded with respect to frequency components to be expanded (in the vicinity of 20 kHz when the original sound is a CD). Thus it becomes possible to expand the band in a more natural form. Note that either one of the gains of the variable amplifier 5 and the variable amplifier 9 may be changed according to the detection result of the level detector 11.

The noise signal generated by the noise signal generating circuit 8 is inputted to the variable amplifier 9 which changes the level of the noise signal. Meanwhile, the output signal of the harmonic generating circuit 3 is inputted to the variable amplifier 5 which changes the level of the output signal. Output signals from the variable amplifier 5 and the variable amplifier 9 are added by the adder 10. Note that each gain of the variable amplifier 5 and the variable amplifier 9 is changed according to the detection result of the level detector 11. The band-pass filter 4 limits the band of the added signal, thus generating the signal for expanding the band. Then, the adder 2 adds the signal for band-expanding to the output of the oversampling type low pass filter 1 to generate the audio signal of which band is expanded.

As described above, in this embodiment also, the band is expanded by simulating the amplifier or the device composing the amplifier. The similar advantage to that of Embodiment 1 is achieved, in which the even-order harmonics with good tone quality and comfortable in listening can be generated.

Further, in this embodiment, the noise signal generating circuit 8 generates a signal for band-expanding which is not correlated to the input signal, and based on this signal the band-expanded signal is generated. Therefore, it is possible to realize band expanding of the audio signal with no incompatible sense in listening and with further less deterioration in the tone quality, compared to a case of expanding the band only by using the harmonics generated from the input signal, as shown in Embodiment 1.

In the audio signal band expanding apparatus 100*b* of this embodiment, the level adjuster 15 may be inserted before the harmonic generating circuit 3.

Embodiment 3

Figure 15:
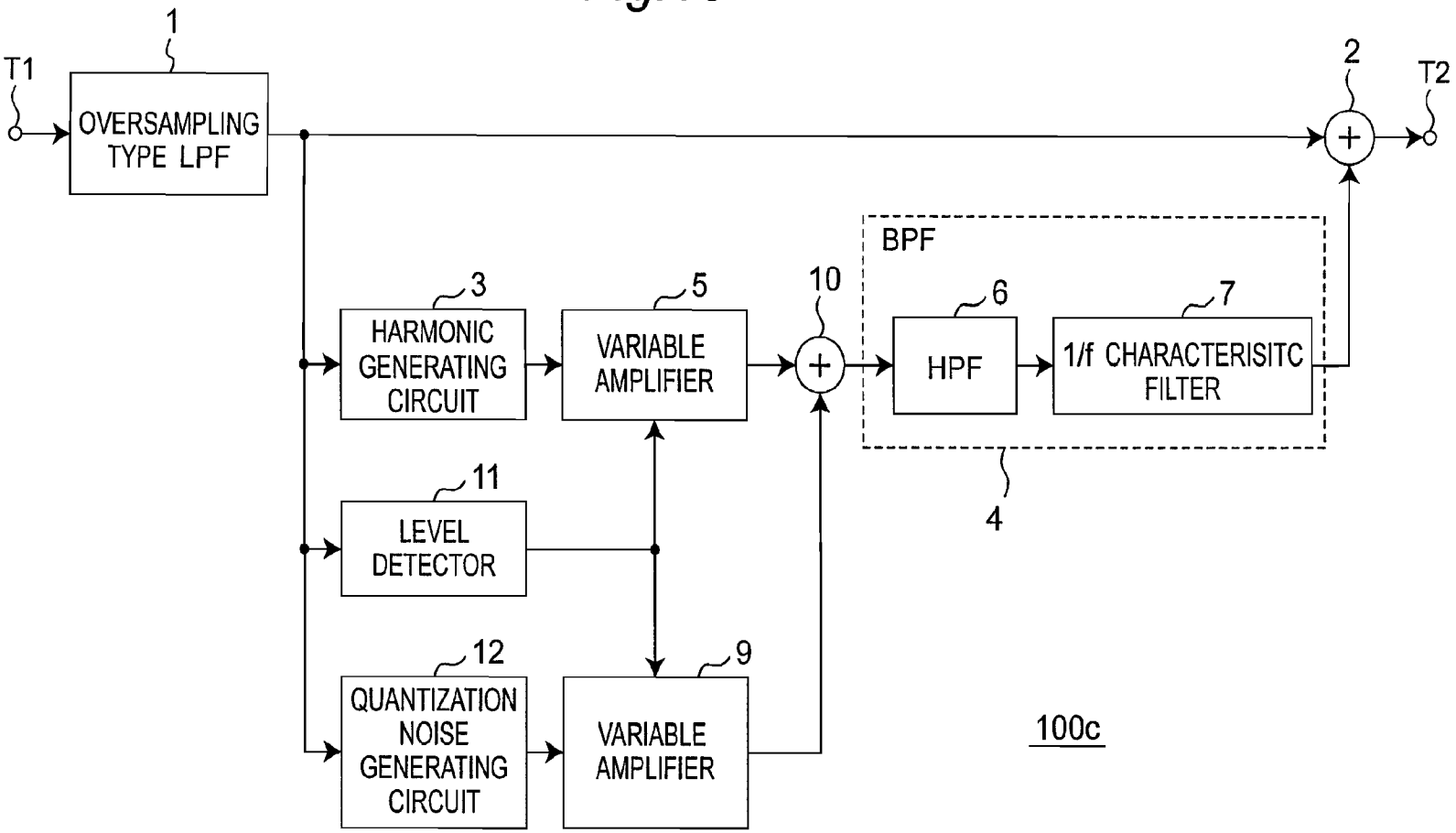
FIG. 15 is a block diagram showing the configuration of the audio signal band expanding apparatus according to an embodiment 3 of the present invention.

FIG. 15 is a block diagram showing the configuration of the audio signal band expanding apparatus according to an embodiment 3 of the present invention. The audio signal band expanding apparatus 100*c* according to this embodiment includes the quantization noise generating circuit 12 for generating a random noise signal based on the digital audio signal from the oversampling type low pass filter 1, instead of the noise signal generating circuit 8 in the configuration of the audio signal band expanding apparatus of FIG. 8.

The quantization noise generating circuit 12 applies a first-order delta sigma modulation (called Δ-Σ modulation, or also called sigma/delta (Σ-Δ) modulation) to the digital audio signal from the oversampling type low pass filter 1 to generate the quantization noise. Thus, a simulated wide band random noise signal correlated to the input signal is generated.

Figure 16:
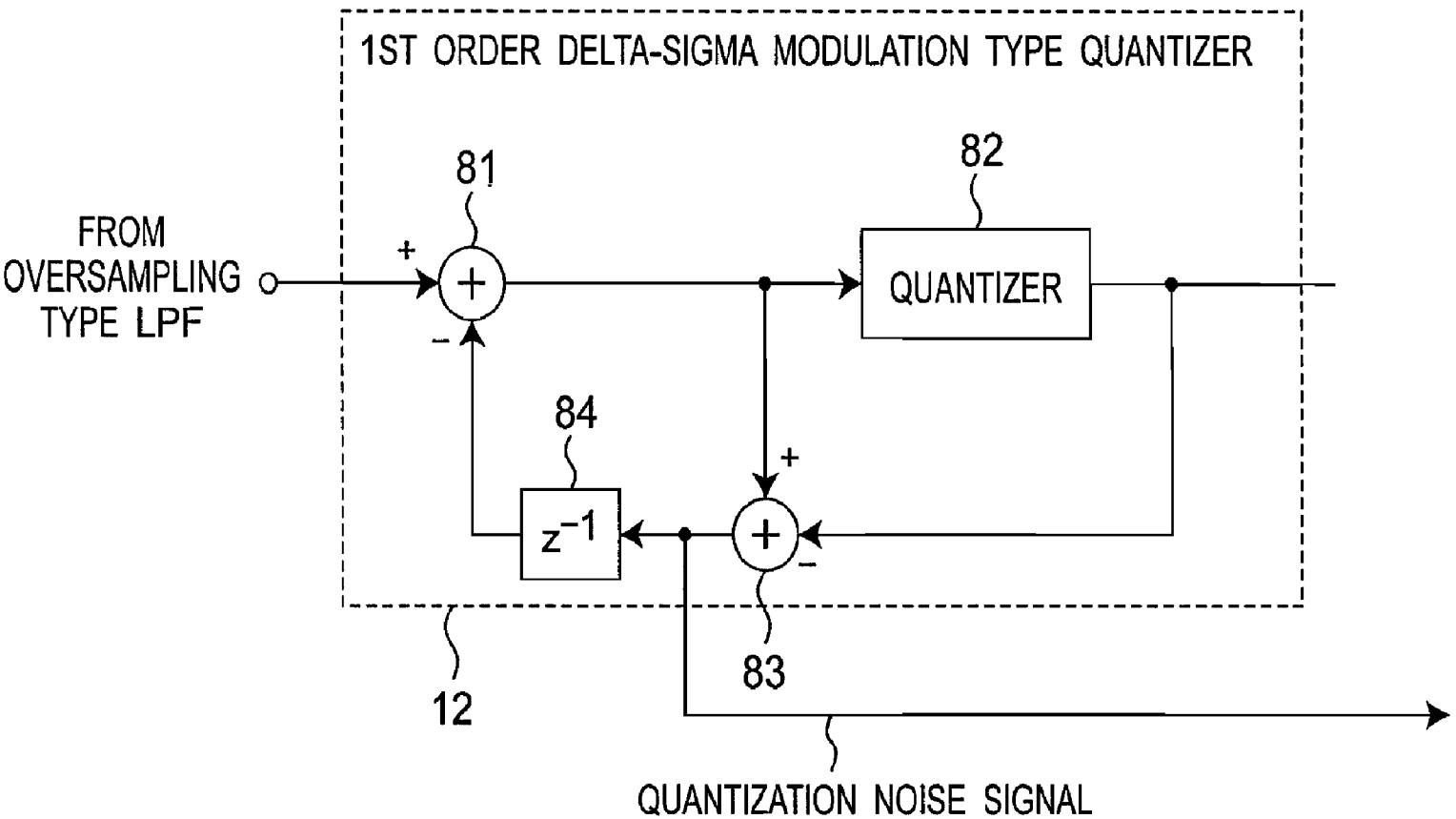
FIG. 16 is a block diagram showing the configuration of a quantization noise generating circuit.

FIG. 16 is a block diagram showing a configuration of the quantization noise generating circuit 12. The quantization noise generating circuit 12 is composed of a first order delta-sigma modulation type quantizer. That is, the quantization noise generating circuit 12 includes a subtractor 81, a quantizer 82 for performing re-quantization, a subtractor 83, and a delay circuit 84 for providing delay by one sample.

The digital audio signal from the oversampling type low pass filter 1 is inputted to the subtractor 81. The subtractor 81 subtracts the digital audio signal sent from the delay circuit 84, from the digital audio signal sent from the oversampling type low pass filter 1 to output the digital audio signal as the subtraction result to the quantizer 82 and the subtractor 83. The quantizer 82 re-quantizes the inputted digital audio signal to output a delta-sigma modulation signal which is the re-quantized digital audio signal to the subtractor 83. The subtractor 83 subtracts the delta-sigma modulation signal sent from the quantizer 82, from the digital audio signal sent from the subtractor 81 to output a quantization noise signal which is the digital audio signal as the subtraction result (generated at the time of quantization). The quantization noise signal is outputted to the subtractor 81 via the delay circuit 84.

Turning to FIG. 15, an operation of the audio signal band expanding apparatus 100*c* according to this embodiment will be explained. Based on the digital audio signal from the oversampling type low pass filter 1, the quantization noise generating circuit 12 generates the re-quantized noise generated at the time of first-order delta-sigma modulation, that is, a noise signal which is a band signal generated based on the digital audio signal of the original sound. The level of the noise signal generated by the quantization noise generating circuit 12 is controlled by the variable amplifier 9.

Meanwhile, the harmonic generating circuit 3 generates the harmonic signals based on the digital audio signal sent from the oversampling type low pass filter 1.

The level detector 11 detects a level fluctuation of the original audio signal which is subjected to the oversampling processing, and changes the gain of the variable amplifier 5 or 9 by its detection result.

The adder 10 sums up the harmonic signals which are generated by the harmonic generating circuit 3 and amplified by the variable amplifier 5 and the noise signal which is generated by the quantization noise generating circuit 12 and amplified by the variable amplifier 5. The digital band-pass filter 4 limits the band of the output signal of the adder 10 to generate a signal for band-expanding. The adder 2 adds the signal for band-expanding to the inputted digital audio signal. Thus, the band expanding is achieved.

Hence, according to this embodiment, regarding the noise signal, the random signal which is generated based on the digital audio signal of the original sound is used for a signal for band-expanding. Thus, in addition to an effect of Embodiment 1, a specific advantage allowing a listener to hear sound more naturally can be obtained compared to when using the signal for band-expanding including only the harmonics.

Note that in this embodiment, the first order delta-sigma modulation type quantizer is used. However, the present invention is not limited thereto, and a multiple order delta-sigma modulation type quantizer may also be used.

Also, in this embodiment, the delta-sigma modulation type quantizer is used. However, the present invention is not limited thereto, and a sigma-delta modulation type quantizer that performs sigma-delta modulation to the input audio signal may also be used.

In addition, in this embodiment, the delta-sigma modulation type quantizer is used. However, the present invention is not limited thereto, and an error signal, which is generated at the time of expanding the input audio signal after compressing it, may be outputted from the quantization noise generating circuit 12.

In addition, in the audio signal band expanding apparatus 100*c*, the level adjuster 15 may be inserted before the harmonic generating circuit 3.

In the above-described embodiments 1 to 3, the audio signal band expanding apparatus is constituted of the digital signal processing circuit of hardware. However, the present invention is not limited thereto. For example, the function of each processing part of the audio signal band expanding apparatus shown in FIG. 1, FIG. 8, and FIG. 15 may be realized by a signal processing program, and this signal processing program may be executed by a DSP (Digital Signal Processor).

In addition, the recording medium storing an audio signal is not limited to a CD, but may be other kind of recording medium (DVD (Digital Versatile Disk), and so on).

Embodiment 4

Figure 17A:
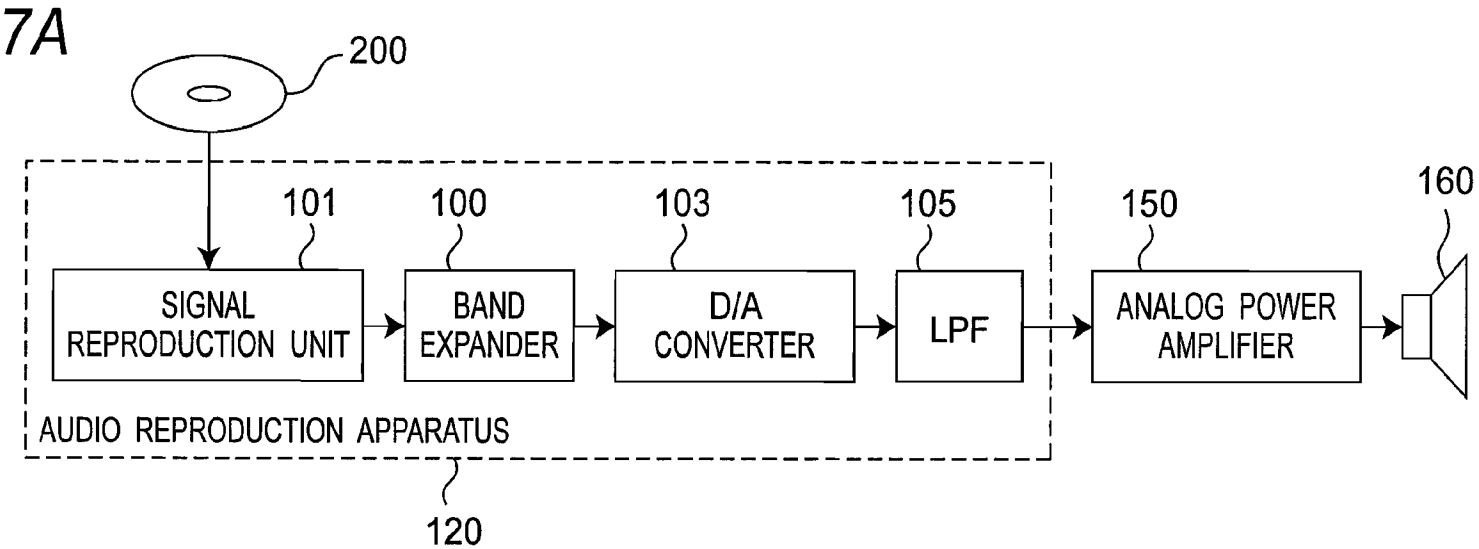
FIGS. 17A and 17B are block diagrams of an audio reproduction system.
Figure 17B:
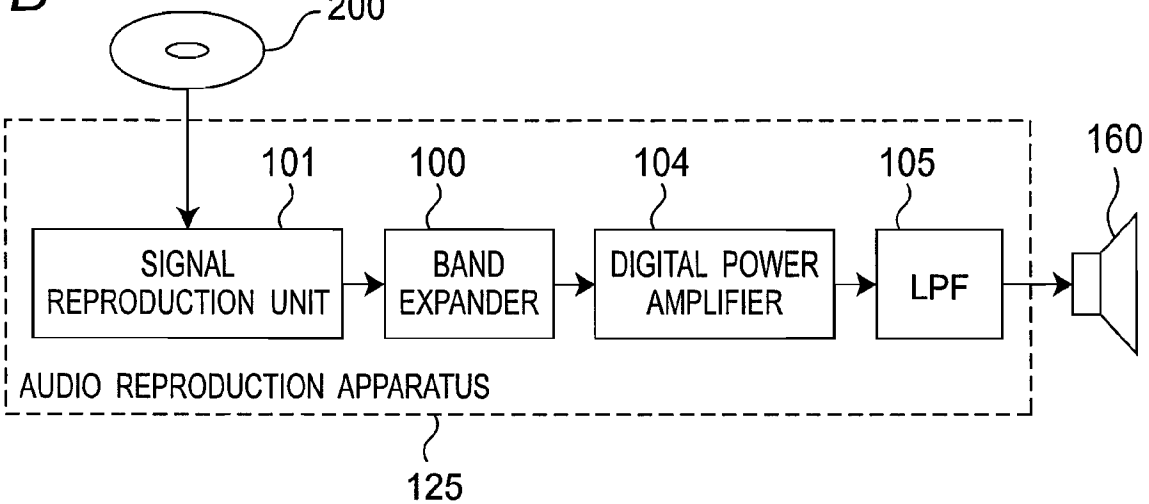
Figure 18:
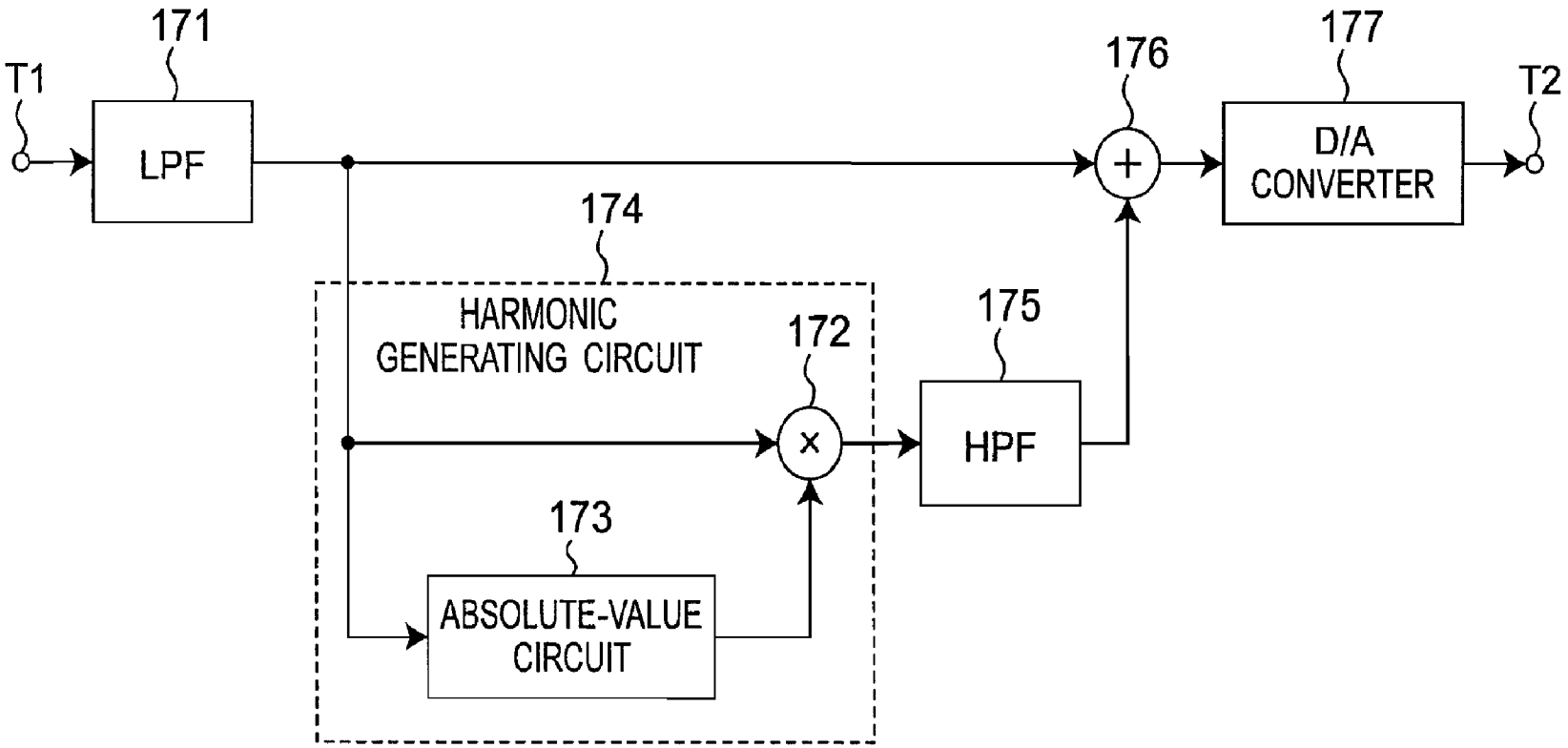
FIG. 18 is a block diagram showing the configuration of a conventional audio signal band expanding apparatus.

FIGS. 17A and 17B show examples of configuration of an audio reproduction system provided with the audio signal band expanding apparatus shown in Embodiments 1 to 3.

FIG. 17A shows a first example of the audio reproduction system. The audio reproduction system shown in FIG. 17A includes an audio reproduction apparatus 120 for reproducing the audio signal from a CD 200 which is a sound source, an analogue power amplifier 150 for amplifying the power of the reproduced audio signal, and a speaker 160 for outputting a voice. The audio reproduction apparatus 120 includes a signal reproduction unit 101, a band expander 100, a D/A converter 103, and a low pass filter 105.

In the audio reproduction apparatus 120, the signal reproduction unit 101 reads audio information from the CD 200, and reproduces the digital audio signal. The band expander 100 has the same configuration and function as the audio signal band expanding apparatus described in any one of Embodiments 1 to 3, which can expand the band of the digital audio signal reproduced by the signal reproduction unit 101. The digital audio signal with the expanded band is converted to an analogue audio signal by the D/A converter 103 with a predetermined high frequency band being cut by the low pass filter 105, and is finally outputted as the audio signal.

The audio signal outputted from the audio reproduction apparatus 120 is amplified by the analogue power amplifier 150 and is inputted to the speaker. Thus, the voice is outputted from the speaker 160.

FIG. 17B shows a second example of the audio reproduction system. The audio reproduction system shown in FIG. 17B includes an audio reproduction apparatus 125 for reproducing the audio signal from a CD 200, and a speaker 160 for outputting the voice. The audio reproduction apparatus 125 includes a signal reproduction unit 101, a band expander 100, a digital power amplifier 104, and a low pass filter 105. In the example shown in FIG. 17B, the digital power amplifier 104 is provided instead of the D/A converter 103 and the analogue power amplifier.

The digital power amplifier 104 amplifies the digital audio signal with the band expanded by the band expander 100, and converts the digital audio signal to the analogue audio signal. The high frequency band region of the audio signal amplified by the digital power amplifier 104 is cut by the low pass filter 105, and the audio signal with the cut high frequency band region is outputted from the speaker 160.

According to the audio reproduction system of this embodiment, the band of the audio signal is expanded by adding a harmonic signals to the original band of the digital audio signal reproduced from the recording medium such as a CD. Thus, a natural tone quality in listening for human beings can be reproduced. In addition, by simulating the input-output characteristics having excellent performance and generating the higher harmonic components for expanding the band, the tone quality comfortable in listening by the human beings can be reproduced.

Specific embodiments of the present invention have been explained, but it is apparent for a person skilled in the art that other many modified examples, amendment, and other usage are possible. Therefore, the present invention is not limited to specific disclosure here, and can be limited only within the scope of the appended claims. Note that this application relates to Japanese Patent Application No. 2005-167956(filed on Jun. 8, 2005), and contents thereof are incorporated herein by reference.

INDUSTRIAL APPLICABILITY

According to the present invention, a high band components generated based on an original audio signal is added to the original audio signal to generate an audio signal with the expanded band, thus realizing a natural tone quality in listening. Therefore, the present invention is useful for an apparatus for reproducing an audio signal which does not include signal components of a predetermined or more frequency band such as a reproduction signal from a compact disk.

The invention claimed is:

1. An apparatus for expanding a band of an audio signal comprising:

an input section for inputting an audio signal having a predetermined band; and a harmonic generator for generating harmonic signals from the input audio signal, wherein the harmonic generator simulates input-output characteristics of a predetermined amplifier or a device included in the amplifier by calculating the input-output characteristics with small signal parameters of an amplifying device included in the predetermined amplifier, to generate the harmonic signals from the input audio signal.

2. An audio reproduction apparatus, comprising:

a signal reproducing unit for reproducing an audio signal from a recording medium storing audio information;

the band expanding apparatus according to claim 1, for expanding a band of an audio signal reproduced by the signal reproducing unit; and an amplifier for amplifying the audio signal outputted from the band expanding apparatus.

3. A method of expanding a band of an audio signal, comprising:

inputting an audio signal having a predetermined band; and generating harmonic signals from the input audio signal, wherein input-output characteristics of a predetermined amplifier or a device included in the amplifier are simulated by calculating the input-output characteristics with small signal parameters of an amplifying device included in the predetermined amplifier, to generate the harmonic signals from the input audio signal.

* * * * *